US005112000A

United States Patent [19]

Derichs et al.

[11] Patent Number: 5,112,000

[45] Date of Patent: May 12, 1992

[54] APPARATUS FOR CONTROLLING THE CONTACT PRESSURE AND/OR RELATIVE MOTION BETWEEN A BOBBIN CYLINDER AND A BOBBIN

[75] Inventors: Josef Derichs, Mönchengladbach; Ferdinand-Josef Hermanns, Erkelenz, both of Fed. Rep. of Germany

[73] Assignee: W. Schlafhorst AG & Co., Mönchengladbach, Fed. Rep. of Germany

[21] Appl. No.: 569,175

[22] Filed: Aug. 17, 1990

[30] Foreign Application Priority Data

Aug. 17, 1989 [DE] Fed. Rep. of Germany ..... 3927142

[51] Int. Cl.[5] ..... B65H 54/42; B65H 54/52; B65H 54/38

[52] U.S. Cl. ..... 242/18 DD; 242/18.1

[58] Field of Search ..... 242/18 DD, 18.1, 18 R, 242/36

[56] References Cited

U.S. PATENT DOCUMENTS 3,241,778 3/1966 Bourgeas ..... 242/18 DD
3,847,364 11/1974 Rohner et al. ..... 242/18.1
4,059,239 11/1977 Hori et al. ..... 242/18.1
4,625,929 12/1986 Slaghuis et al. ..... 242/18.1

FOREIGN PATENT DOCUMENTS 879508 4/1953 Fed. Rep. of Germany .
1083718 6/1960 Fed. Rep. of Germany .
2100305 4/1972 Fed. Rep. of Germany .
2220856 11/1972 Fed. Rep. of Germany .
3703869 8/1988 Fed. Rep. of Germany .

*Primary Examiner*—Stanley N. Gilreath
*Attorney, Agent, or Firm*—Herbert L. Lerner; Laurence A. Greenberg

[57] ABSTRACT

A machine has a frame, a rotatable configuration of two partners in the form of a bobbin cylinder and a bobbin resting on the bobbin cylinder for winding and unwinding yarn or tape-like material, one of the partners being firmly attached to the frame, and a carrier being movable relative to the one partner for supporting the other of the partners. An apparatus for controlling at least one of contact pressure and relative motion of the partners of the rotatable configuration includes an electromechanical power proportional or current proportional torque adjuster connected to the carrier, and a control device connected to the adjuster for controlling the contact pressure with the adjuster to provide slip between the partners in ribbon zones.

31 Claims, 2 Drawing Sheets

Figure 1:
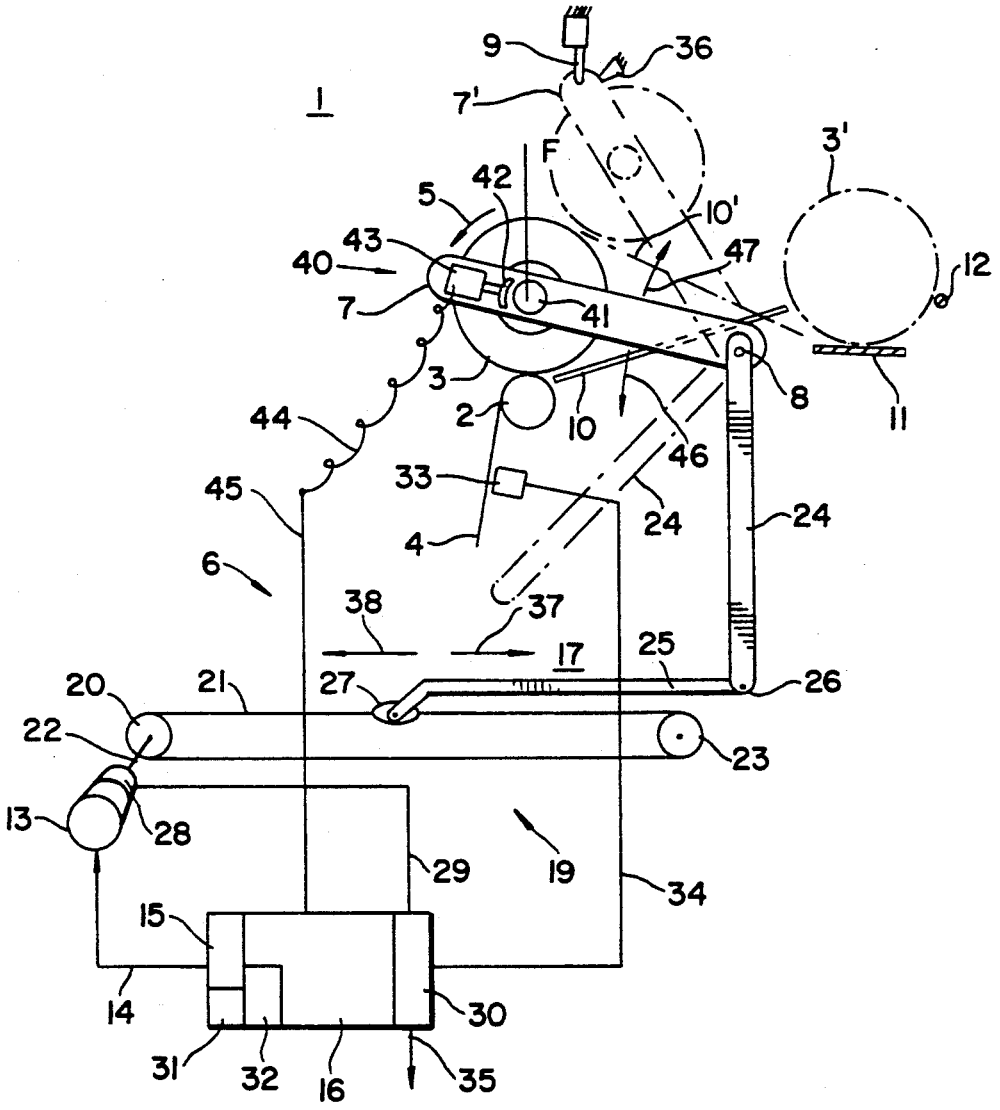

APPARATUS FOR CONTROLLING THE CONTACT PRESSURE AND/OR RELATIVE MOTION BETWEEN A BOBBIN CYLINDER AND A BOBBIN

The invention relates to an apparatus for controlling the contact pressure and/or relative motion of a rotatable configuration of a bobbin cylinder and a bobbin resting on the bobbin cylinder for winding or unwinding yarn or tape-like material, one partner in the configuration being firmly attached to or stationarily supported on a frame, and the other partner being supported in a carrier being movable relative to the first partner.

Such an apparatus can be used, for instance, at the winding station of an automatic bobbin winding machine. A mechanically or hydraulically operating apparatus is already known that is capable of adjusting the contact pressure, keeping it constant or controlling it.

It is accordingly an object of the invention to provide an apparatus for controlling the contact pressure and/or relative motion between a bobbin cylinder and a bobbin, which overcomes the hereinafore-mentioned disadvantages of the heretofore-known devices of this general type and which controls the contact pressure and/or the relative motion in such a way that relatively trouble-free high-speed winding operation is assured.

With the foregoing and other objects in view there is provided, in accordance with the invention, in a machine having a frame, a rotatable configuration of two partners in the form of a bobbin cylinder and a bobbin resting on the bobbin cylinder for winding and unwinding yarn or tape-like material, one of the partners being firmly attached to the frame, and a carrier being movable relative to the one partner for supporting the other of the partners, an apparatus for controlling at least one of contact pressure and relative motion of the partners of the rotatable configuration, comprising an electromechanical power proportional or current proportional torque adjuster connected to the carrier, and a control device connected to the adjuster for controlling the contact pressure with the adjuster to provide slip between the partners in ribbon zones.

By varying the voltage, the frequency, or the curve form of the voltage or current, or by varying the current flowing through the adjuster, it is possible to achieve a highly sensitive control of the contact pressure, which reacts quickly and accurately, in accordance with requirements of the winding operation.

The novel apparatus better and more optimally adapts the contact pressure and/or the relative motion than conventional equipment, even during starting, stopping, interruptions to the winding operation and malfunctions of all types.

The configuration may be provided in such a way that the bobbin cylinder is supported by being firmly attached to the frame, while in contrast the bobbin is supported in the movable carrier, for instance. However, although this would be less conventional, it is also possible for the bobbin to be supported by being firmly attached to the frame while in contrast the bobbin cylinder is supported in the movable carrier. In accordance with another feature of the invention, the adjuster is constructed as a force transducer operating while stationary and exerting a moment or force upon the carrier. A force is suitably transmitted if the carrier is guided in straight guides, for instance. A moment is suitably transmitted if the carrier is pivotably supported. The pivot point or pivot axis in this case can naturally also be firmly attached to the frame.

It is particularly advantageous if, in accordance with a further feature of the invention, the adjuster or force transducer is constructed as an electric motor suitable for stationary operation. In accordance with an added feature of the invention, the electric motor is advantageously a DC motor, and specifically, the electric motor is advantageously constructed as a disk armature motor. Such motors have proved experimentally to be particularly well suited for controlling the contact pressure. In accordance with an additional feature of the invention, the control device is a computer that is connected to the adjuster through a current end stage, for instance a DC current end stage.

In accordance with yet another feature of the invention, the control device includes a contact pressure program of the bobbin travel that is adapted to the applicable bobbin structure, and it then controls the current of the adjuster by this program. Such a program can, for instance, be applicable to the entire bobbin travel from the beginning to the end of winding. However, in automatic bobbin winders in which a yarn is wound upward to a bobbin, interruptions occur during the bobbin travel. During the interruptions (which are, for instance, occasioned by cleaning procedures), splicing or tying operations are performed, and subsequently the bobbin travel continues.

The contact pressure program mentioned above may then be configured in such a way that after the interruption signal until the standstill, a particular curve of the contact pressure to be adhered to is specified, and another curve in turn is specified for the ensuing restarting operation. The particular contact pressure curve is then somewhat different or is modified somewhat depending on how big the bobbin diameter already is, and accordingly how quickly the bobbin can and may be allowed to be braked and started up again. Accordingly, the contact pressure program can certainly take these various interruptions arriving at irregular time intervals into account to adjust the contact pressure that is recognized to be particularly favorable, which can accordingly also be specified in advance, all for the sake of a winding operation that is gentle to the yarn yet as fast as possible.

In accordance with yet a further feature of the invention, the control device is connected to a ribbon breaker and it also controls the current of the adjuster on the indication of ribbon breaking.

If cross-wound bobbins or cheeses, for instance, are formed with a so-called random winding and are particularly suitable as payout bobbins in the creel or are particularly suitable as dyeing bobbins, as a rule it is necessary to ensure that welts of parallel yarns that would make the bobbin structure inhomogeneous are not related in the bobbin structure. In order to prevent these areas of inhomogeneity which, for instance, occur when the ratio between the reversing speed and the bobbin rpm is an integral multiple, the aforementioned ribbon breakers are used.

Various constructions of such ribbon breakers exist. The ribbon breaker may, for instance, provide that the bobbin drive be briefly interrupted periodically or nonperiodically, so that the ratio between the reversing speed and the bobbin rpm is accordingly briefly disrupted. The applicable contact pressure, if it is to be optimal, must then react to this as well and it must adapt itself to it.

However, the ribbon breaker may also provide for the ribbon breaking to be performed solely by abrupt variation of the contact pressure, and the novel apparatus is highly suitable precisely for this purpose.

In accordance with yet an added feature of the invention, the ribbon breaker has an interval brake acting upon the bobbin, and the current of the adjuster during the braking interval is varied in the direction of reducing the contact pressure. Accordingly, the current as well as the adjuster itself follow the braking intervals precisely, and in this connection the current may even follow the braking force as well and not merely the interval.

The aspect of the invention just mentioned above is achieved particularly effectively if, in accordance with yet an additional feature of the invention, the interval brake has an electromagnet drive that is connected to the control device, and the control device varies the current of the adjuster in proportion, or inversely proportionally, to the current of the electromagnet driver.

If the adjuster acts positively, for instance, or in other words in the same direction as gravity, then its current is varied inversely proportionally to the current of the electromagnet drive if the electromagnet drive likewise acts positively, or in other words if a direct-action brake is involved, rather than a brake of the brake lifter type. As long as the brake is in action, the contact pressure should be less than whenever the brake is not in action.

In accordance with again another feature of the invention, it is advantageous in many cases if the carrier or adjuster can be moved by the control device, after the termination of winding operation, into an end position, in which the two partners of the configuration are out of contact with one another. In this case the novel apparatus serves not merely to control the contact pressure but it also performs an additional purpose as well, because it does indeed react very quickly to an interruption in the winding operation or in the shutoff processes in order to move the two partners out of contact with one another.

In accordance with again a further feature of the invention, in the end position, a decoupling device can be operative for decoupling or separating the bobbin. However, this is necessary only if an end shutoff takes place, or in other words once the bobbin has been wound to completion. During interruptions, a second end position may be provided, in which the carrier is not pivoted as far upward as is the case in the end position in which the bobbin is to be separated or decoupled or removed from the winding apparatus.

In accordance with again an added feature of the invention, the adjuster is connected to the carrier through a mechanical operative connection.

In accordance with again an additional feature of the invention, the carrier is a pivotably supported creel of a conventional type and the mechanical operative connection is disposed in such a way that it exerts a torque upon the creel by the indication of the adjuster.

In accordance with still another feature of the invention, the mechanical operative connection is a torque translator that transmits the torque of the rotor of the adjuster, which is constructed as an electric motor, to the carrier.

In accordance with still a further feature of the invention, the torque translator has a transmission or gearing with a drive wheel and a driven or power take-off element, in which the drive wheel is connected to the rotor of the electric motor, and the driven element is connected to the carrier. Driven wheels, such as driven gear wheels, can serve as the driven elements.

In accordance with still an added feature of the invention, the connection between the driven element and the carrier is established by a rod linkage configuration.

In accordance with still an additional feature of the invention, the transmission is a traction mechanism transmission, in which the traction mechanism serves as the driven element. A traction mechanism transmission of this kind may, for instance, have two gear wheels, and it may have an endless toothed belt or an endless chain as the traction mechanism. A rod linkage configuration then provides a connection between one point of the toothed belt or chain and the carrier.

In accordance with another feature of the invention, the rotor of the electric motor, or a rotatable part driven by the rotor, is connected to a transducer that detects changes in rotational angle, and an evaluator communicating with the control device is connected to the transducer. Naturally, the evaluation device may be integrated with the control device. The transducer may, for instance, be mounted on the rotor shaft, or it may be connected to any transmission element, for instance a gear wheel of the gear driven by the electric motor.

In accordance with a further feature of the invention, the transducer is an incremental transducer or an optical linescale transducer. In such an embodiment, it is, for instance, possible to obtain a plurality of individual pulses upon one rotation of the rotor shaft, in order to detect the diameter of the bobbin to be wound accurately to several tenths of a millimeter.

In accordance with an added feature of the invention, the evaluator device for evaluating the rotational angle being measured is an indicator for a malfunction in terms of the carrier position or bobbin diameter, and in terms of a stagnation or a disproportionate increase in the carrier motion. It is accordingly possible to detect not merely the required maximum required diameter but rather any diameter change, or to detect the progressive growth of the diameter. A stagnation in an ongoing winding operation naturally signals a malfunction of some type. An intervention can then be made in the winding operation, for instance by shutting down one winding station. A disproportionate increase in the carrier motion signals a drum winding.

In accordance with an additional feature of the invention, the control device includes a measuring instrument for the current flowing through the adjuster and an evaluator device connected to this measuring instrument for evaluation of the measured current in terms of the contact pressure and/or bobbin weight and/or stagnation and/or a disproportionate increase in the carrier motion as an indication of a malfunction.

If it is provided that the contact pressure and thus the current intensity vary continuously during the bobbin travel, then stagnation or a disproportionate variation in the current intensity already signals a malfunction. If the bobbin weight during the bobbin travel no longer varies, or in other words is stagnant, then once again a malfunction exists.

In accordance with yet another feature of the invention, a travel sensor monitoring the yarn-like or tape-like material is connected to the control device or to one of its evaluator devices, and the control device or one of its evaluation devices is issues a drum winding signal and a shutoff signal in the event that with the material traveling, stagnation of the bobbin diameter or bobbin weight, or a disproportionate increase in the carrier motion results from the measurement of rotational angle, and/or stagnation or a disproportionate variation in current intensity results from the current measurement, as an indication of a malfunction.

Accordingly the control device or one of its evaluation devices is, for instance, equipped with an electronic device that emits the appropriate signal in the presence of an AND condition. A requirement of this AND condition is that a travel signal and a signal indicating disproportionate increase or stagnation must be simultaneously received in order for the apparatus to recognize a malfunction in a winding operation and to initiate the desired provisions and issue the applicable warnings.

In accordance with a concomitant feature of the invention, the creel has a rolling surface being upwardly pivotable in common with it into an end position by the adjuster, and the bobbin can be rolled on the surface to a bobbin collecting location, under the influence of gravity, after the decoupling or separating device comes into action. Previously it was typical to provide a movable bobbin changer for this purpose, or else the bobbin had to be removed from the creel by hand. According to the invention, the removal is then performed automatically without delay and without special drive devices.

Other features which are considered as characteristic for the invention are set forth in the appended claims.

Although the invention is illustrated and described herein as embodied in an apparatus for controlling the contact pressure and/or relative motion between a bobbin cylinder and a bobbin, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figures 2, 3:
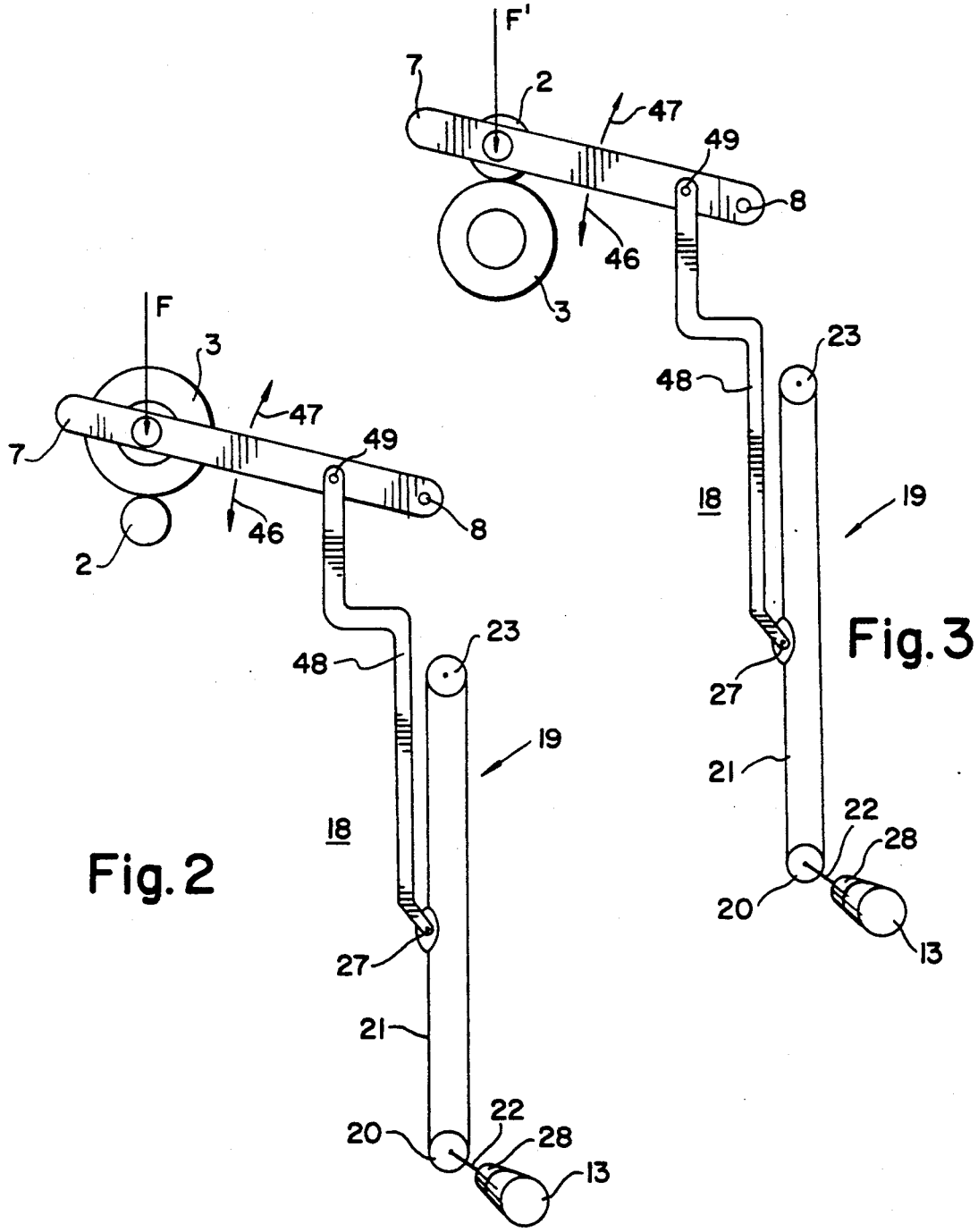

FIG. 1 is a schematic and diagrammatic elevational view of a first exemplary embodiment of the invention; and FIGS. 2 and 3 are elevational views showing further exemplary embodiments.

Referring now to the figures of the drawing in detail and first, particularly, to FIG. 1 thereof, there is seen a winding station 1 which includes, among other features, a configuration of a bobbin cylinder 2 and a bobbin 3, and is part of an automatic bobbin winder that is not shown in further detail herein.

Although the term "bobbin cylinder" is intended to include cylinders of any type, such as a support cylinder, a drive cylinder, or the like, in this exemplary embodiment a bobbin cylinder 2 is provided which has a non-illustrated reverse winding groove for laying a yarn 4 to be wound up in reversing direction, and which is driven by a non-illustrated motor at a predetermined circumferential speed. The bobbin 3 resting on the bobbin cylinder 2 rotates in the direction of an arrow 5 as is driven by the bobbin cylinder 2, in this case by friction. The bobbin cylinder 2 and the bobbin 3 are accordingly in contact with one another, and a certain contact pressure, which is controllable by a device 6, prevails between them. One partner of the aforementioned configuration, namely the bobbin cylinder 2, is supported by being attached firmly to the frame. This can be provided, for instance, by mounting the bobbin cylinder 2 on the shaft of the drive motor. Other supports which are attached firmly to the frame are also possible but are not illustrated herein. The other partner in the configuration, namely the bobbin 3, is supported in a carrier 7 that is movable relative to the first partner. The carrier 7 is a conventional creel which is pivotably supported about a pivot shaft 8, in which one side leg, for instance, such as the side leg visible in FIG. 1, is resiliently pressed against a support tube or sleeve of the bobbin 3. If the carrier or creel 7 is pivoted upward into an end position 7', the creel opens because its front leg strikes a decoupling device or separator 9, which pushes the side arm to the side and automatically separates the bobbin 3.

The creel 7 is provided with a rolling surface 10, which is pivoted upward jointly with the creel 7 and likewise attains an end position 10' whenever the creel is in its end position 7'. The decoupled, separated bobbin 3 can then roll over the rolling surface 10 to a bobbin collection location 11, where it then assumes a position 3', for example. The bobbin collection location 11 is constructed, for instance, as a bobbin conveyor belt, which can be switched on from time to time to remove the collected bobbins of the various winding stations. A protecting rod 12 prevents the bobbin 3 from rolling onward beyond the bobbin collection location 11. The carrier 7 is connected to an electromechanical, proportional current torque adjuster 13. A line 14 connects the adjuster 13 to a DC current end stage 15 of a control device 16. The control device 16 is constructed as a computer.

The adjuster 13 is a force transducer that operates while stationary, transmits a moment to the carrier 7, and is constructed as an electric motor that is suitable for stationary operation. The motor is a DC motor. The adjuster 13 is connected to the carrier 7 through a mechanical operative connection 17. The operative connection 17 is employed in such a way that it exerts a torque upon the creel or carrier 7 on the indication of the adjuster 13.

The mechanical operative connection 17 mentioned above is constructed as a torque translator that transmits the torque of the rotor of the electric motor or adjuster 13 to the carrier 7. The torque translator 17 has a transmission 19 with a drive wheel 20 and a driven or power take-off element 21. The drive wheel 20 is connected to the rotor of the electric motor 13 by a motor shaft 22. The transmission 19 is a traction mechanism transmission, having a traction mechanism which is constructed as a toothed belt and serves as the driven or power take-off element 21. The endless toothed belt 21 is wrapped around the drive wheel 20, which is constructed as a gear wheel, as well as around a further gear wheel 23 that is supported by being attached firmly to the frame. The connection between the driven or power take-off element 21 and the carrier 7 is furnished by a rod linkage configuration, including a lever 24 connected firmly to the carrier 7 and a lever 25 connected pivotably to the level 24 and to the power take-off element 21. Pivot points are indicated at reference numerals 26 and 27.

The rotor of the electric motor 13 is connected to a transducer 28 that detects changes in rotational angle. The transducer 28 is connected by a line 29 to an evaluation device 30 that is connected to the control device 16. The transducer 28 is mounted on the motor shaft 22. The transducer 28 is constructed as an incremental transducer, and specifically as an optical line-scale transducer of a conventional type. The evaluation device 30 is installed for evaluating the measured rotational angle with respect to the carrier position or bobbin diameter, and with respect to stagnation or a disproportionate increase in carrier motion, as an indication of a malfunction.

The control device 16 also includes a measuring instrument or measuring circuit 31 of a conventional type for measuring the current flowing through the adjuster 13, and an evaluation device 32 connected to the measuring instrument 31, which is installed for evaluating the measured current with respect to the contact pressure and/or bobbin weight and/or stagnation and/or disproportionate variation in the current intensity, as an indication of a malfunction.

A travel sensor 33 that monitors the travel or standstill of the yarn 4 is disposed below the bobbin cylinder 2 and is connected by a line 34 to the evaluation device 30 of the control device 16. The evaluation device 30 is used to output a malfunction signal and a shutoff signal over a line 35 in the event that stagnation of the bobbin diameter or bobbin weight, or a disproportionate rise in carrier motion, ascertained from the rotary angle measurement, and/or stagnation or disproportionate variation of the current intensity, ascertained from the current measurement, is found as an indication for a malfunction, when the yarn 4 is traveling.

The control device 16 is capable of driving the electric motor 13 counterclockwise or clockwise, depending on whether a force F oriented toward the bobbin cylinder 2 is to be brought to bear on the carrier 7, or the carrier 7 is to be pivoted upward, even as far as its end position 7', as the result of an interruption in ongoing winding or because of a bobbin change. In the end position 7', the carrier presses against a stop 36 which is fixed to the housing. Upon an interruption in winding, the traction mechanism 21 is pulled in the direction of an arrow 37. Upon a bobbin change, it is pulled in the direction of an arrow 38, far enough to ensure that the lever 24 reaches an end position 24'.

The control device 16 has a bobbin travel contact pressure program adapted to the particular bobbin structure, and it controls the current flowing to the adjuster 13 which originates in the DC current end stage 15, in accordance with this program.

The points referred to at the outset above can be taken into account in programming, so that sensitive adaptation of the applicable contact pressure to given conditions of a winding operation is effected, and the increase in weight of the bobbin, which affects the contact pressure, should also be taken into account.

The control device 16 is connected by lines to a ribbon breaker 40. The control device 16 controls the current of the adjuster 13 by the indication of ribbon breaking as well. The ribbon breaker 40 has an interval brake 42 acting upon a turntable 41 that rotates with the bobbin 3. The brake 42 is drivable by an electromagnet drive mechanism 43. The electromagnet drive mechanism 43 is connected to the control device 16 by a flexible line 44 and a line 45.

The control device 16 assures that the current of the adjuster 13 is varied during- the braking interval in the direction of a reduction of contact pressure, and under the conditions given in this case this is performed inversely proportionally to the current of the electromagnet drive mechanism 43.

FIG. 1 shows that the creel 7 is moved in the direction of an arrow 46 whenever the toothed belt 21 moves in the direction of the arrow 37. However, the creel 7 is pivoted upward in the direction of an arrow 47 as soon as the toothed belt 21 moves in the direction of the arrow 38.

The apparatus shown in FIG. 1 functions as follows:

On the assumption that the weight of the bobbin 3 is insufficient to effect the contact pressure required at a given time, the electric motor 13 is run clockwise, so that the apparatus 6 exerts a force F directed toward the bobbin cylinder 2 upon the bobbin 3. The magnitude of the force F is dimensioned in accordance with the bobbin travel program contained in the control device 16. During bobbin travel, a current flows through the line 45 at intervals, so as to press the interval break 42 against the turntable 41 of the bobbin 3 at intervals. On the indication of current flowing through the lines 44, 45, the current flowing through the line 14 is reduced. During the braking interval, the contact pressure is accordingly lessened. If the electric motor 13 is accordingly operated in quasi-stationary operation, the toothed belt 21 is pulled in the direction of the arrow 37. The transducer 28 continuously measures the applicable rotary angle of the shaft 22 of the motor 13. The evaluation device 30 evaluates the measurement findings.

If the travel sensor 33 then reports a yarn interruption, the electric motor 13 is immediately switched from clockwise to counterclockwise travel, in order to raise the creel 7. At the same time a shutoff signal is sent over the line 35, optionally along with a yarn interruption warning signal. The drive of the bobbin cylinder 2 can then be stopped and the yarn break can be taken care of. The electric motor 13 is subsequently switched back to clockwise travel per the program, and as soon as the bobbin 3 rests on the bobbin cylinder 2 the bobbin cylinder 2 can be started up again. Then, during the startup phase, the contact pressure varies in accordance with a special startup program, which is integrated with the control device 16. The pressing force follows a curve having a shape which depends on how large the bobbin 3 already is, or what diameter it has already attained. After the startup phase, as soon as the bobbin cylinder has attained its specified winding speed, the pressing force then again follows a curve intended for normal winding operation.

Upon attaining the intended bobbin fullness, the procedure may be carried out in such a way that the drive of the bobbin cylinder 2 is switched off, while the bobbin 3 still rests on the bobbin cylinder 2. During the slowdown phase, a separate control of the contact pressure in accordance with a special "slowdown curve" is possible. However, if the termination of the winding process takes place in accordance with the measured yarn length, then the bobbin 3 is simply raised from the bobbin cylinder by the switchover of the electric motor 13 from clockwise to counterclockwise operation, and at the same time the interval brake 42 is set to continuous braking. The bobbin 3 then comes to a stop very quickly, and as soon as the creel 7 has reached the position 7', the separator 9 opens the creel, and the fully wound bobbin rolls over the rolling surface 10 to the bobbin collection location 11. Subsequently, a new tube can be mounted in the creel either manually or automatically, and a new winding process can then begin.

If stagnation is ascertained while the yarn 4 is traveling, either by the transducer 28 or by the measuring instrument 31, then the evaluation device 30 evaluates this as a lap roll forming somewhere on rotating parts. The winding station I or its bobbin cylinder 2 is then stopped through the use of the line 35. In contrast, if the evaluation device 30 or the evaluation device 32 ascertains a disproportionate increase in the upward motion of the creel 7, or a disproportionate increase in the current flowing through the line 14, then the two evaluation devices likewise interpret this as an indication of a lap winding, which is wrapped around either the bobbin cylinder 2 or around the bobbin 3 itself, in the latter case forming a welt. In this case again, the winding station 1 is put out of operation through the line 35.

The embodiment of the invention shown in FIG. 2 differs from that of FIG. 1 in the following respects:

In a torque translator 18 shown in FIG. 2, the traction mechanism gear 19 is vertical, and the rod linkage configuration connecting the driven or power take-off element 21 to the carrier 7 in this case includes a crank-type lever 48, which is pivotably connected to the carrier or creel 7 and to the driven or power take-off element or toothed belt 21. Pivot points are shown at reference numerals 49 and 27.

The embodiment of the invention according to FIG. 3 differs from that of FIG. 2 in the following respects:

In this case, the partners in the configuration of the bobbin cylinder and the bobbin have traded places. The bobbin cylinder 2 is located in the carrier 7, while the bobbin 3 is supported by being fixed to the frame. A force F' is transmitted by the creel 7 to the bobbin cylinder 2 in the direction toward the bobbin 3. When the carrier 7 pivots upward, naturally the bobbin cylinder 2 is not is removed, so that there is no decoupling device cooperating with the carrier nor any rolling surface for the bobbin.

In all of the embodiments of the invention, an alternative is possible in which a central set-point value specification of the contact pressure or of compensation for the increasing bobbin weight is provided, for example from a central computer.

Alternatively, an electric machine constructed as a disk armature having a rotor which rotates with the bobbin may, for instance, be used as the brake. The machine can be operated as a generator and may furnish a friction-free brake having a braking current which can be minimized, for instance, along with the stator of the electromagnet drive mechanism. The result of minimizing the brake current is that the ribbon breaking can be activated during all of the bobbin travel without any disadvantages.

We claim:

1. In a machine having a frame, a rotatable configuration of two partners in the form of a bobbin cylinder and a bobbin resting on the bobbin cylinder for winding yarn or tape-like material onto the bobbin in a traversing motion, one of the partners being firmly attached to the frame and one of the partners being driven by drive means, and a carrier being movable relative to the one partner for supporting the other of the partners, an apparatus for controlling at least one of contact pressure and relative motion of the partners of the rotatable configuration, comprising an electromechanical power proportional or current proportional torque adjuster connected to the carrier, and a control device connected to said adjuster for controlling the contact pressure with said adjuster to provide slip between the partners in ribbon zones resulting from the traversing motion.

2. Apparatus according to claim 1, wherein said adjuster is a force transducer operating while stationary and transmitting a moment or a force upon the carrier.

3. Apparatus according to claim 1, wherein said adjuster is an electric motor for stationary operation.

4. Apparatus according to claim 3, wherein said electric motor is a DC motor.

5. Apparatus according to claim 3, wherein said electric motor is a disk armature motor.

6. Apparatus according to claim 1, wherein said control device is a computer having a current end stage connected to said adjuster.

7. Apparatus according to claim 1, wherein said control device has a contact pressure program for bobbin travel being adapted to an applicable bobbin structure, and said control device controls current of said adjuster with the program.

8. Apparatus according to claim 1, including a ribbon breaker connected to said control device, said control device controlling current of said adjuster on an indication of ribbon breaking.

9. Apparatus according to claim 8, wherein said ribbon breaker has an interval brake acting upon the bobbin, and the current of said adjuster during a braking interval is varied for reducing the contact pressure.

10. Apparatus according to claim 9, wherein said interval brake has an electromagnet drive connected to said control device, and said control device varies the current of said adjuster proportionally or inversely proportionally to the current of said electromagnet drive.

11. Apparatus according to claim 1, wherein said control device moves the carrier after termination of a winding operation into an end position in which the two partners of the configuration are out of contact with one another.

12. Apparatus according to claim 1, wherein said control device moves said adjuster after termination of a winding operation into an end position in which the two partners of the configuration are out of contact with one another.

13. Apparatus according to claim 11, including a decoupling device for decoupling or separating the bobbin in the end position.

14. Apparatus according to claim I, including a mechanical operative connection connecting said adjuster to the carrier.

15. Apparatus according to claim 13, wherein the carrier is a pivotably supported creel, and said mechanical operative connection exerts a torque upon the creel on an indication of said adjuster.

16. Apparatus according to claim 14, wherein said adjuster is an electric motor having a rotor, and said mechanical operative connection is a torque translator transmitting torque of the rotor to the carrier.

17. Apparatus according to claim 16, wherein said torque translator has a transmission with a drive wheel and a driven element, said drive wheel is connected to the rotor of the electric motor, and said driven element is connected to the carrier.

18. Apparatus according to claim 17, including a rod linkage configuration establishing a connection between said driven element and the carrier.

19. Apparatus according to claim 17, wherein said transmission is a traction mechanism transmission with a traction mechanism serving as said driven element.

20. Apparatus according to claim 3, wherein the electric motor has a rotor, and including a transducer connected to the rotor of the electric motor for measuring and detecting changes in rotational angle, and an evaluator communicating with said control device and being connected to said transducer.

21. Apparatus according to claim 3, wherein the electric motor has a rotor, and including a rotatable part driven by the rotor, a transducer connected to the rotatable part for measuring and detecting changes in a rotational angle, and an evaluator communicating with said control device and being connected to said transducer.

22. Apparatus according to claim 21, wherein said transducer is an incremental transducer.

23. Apparatus according to claim 21, wherein said transducer is an optical line-scale transducer.

24. Apparatus according to claim 21, wherein said evaluator device evaluates the rotational angle being measured and is an indicator for a malfunction in terms of the carrier position or bobbin diameter, and in terms of stagnation or a disproportionate increase in the carrier motion.

25. Apparatus according to claim 1, wherein said control device includes a measuring instrument for current flowing through said adjuster and an evaluator device connected to said measuring instrument for evaluating the measured current in terms of the contact pressure and/or bobbin weight and/or stagnation and/or a disproportionate increase in the carrier motion as an indication of a malfunction.

26. Apparatus according to claim 1, including an electric motor with a rotor, a transducer connected to the rotor of said electric motor for measuring and detecting changes in rotational angle, a travel sensor connected to said control device for monitoring the yarn or tape-like material, said control device issuing a cylinder winding signal and a shutoff signal in the event t hat stagnation of the bobbin diameter or bobbin weight, or a disproportionate increase in the carrier motion results from the measurement of the rotational angle, and/or stagnation or a disproportionate variation in current intensity results from the current measurement, as an indication of a malfunction, with the material traveling.

27. Apparatus according to claim 20, including a travel sensor connected to said evaluator device for monitoring the yarn or tape-like material, said evaluation device issuing a drum winding signal and a shutoff signal in the event that stagnation of the bobbin diameter or bobbin weight, or a disproportionate increase in the carrier motion results from the measurement of the rotational angle, and/or a stagnation or a disproportionate variation in current intensity results from the current measurement, as an indication of a malfunction, with the material traveling.

28. Apparatus according to claim 21, including a travel sensor connected to said evaluator device for monitoring the yarn or tape-like material, said evaluation device issuing a drum winding signal and a shutoff signal in the event that stagnation of the bobbin diameter or bobbin weight, or a disproportionate increase in the carrier motion results from the measurement of the rotational angle, and/or a stagnation or a disproportionate variation in current intensity results from the current measurement, as an indication of a malfunction, with the material traveling.

29. Apparatus according to claim 25, including an electric motor with a rotor, a transducer connected to the rotor of said electric motor for measuring and detecting changes in rotational angle, a travel sensor connected to said evaluator device for monitoring the yarn or tape-like material, said evaluation device issuing a cylinder winding signal and a shutoff signal in the event that stagnation of the bobbin diameter or bobbin weight, or a disproportionate increase in the carrier motion results from the measurement of the rotational angle, and/or a stagnation or a disproportionate variation in current intensity results from the current measurement, as an indication of a malfunction, with the material traveling.

30. Apparatus according to claim 13, including a rolling surface being upwardly pivotable in common with the creel into an end position by said adjuster, and a bobbin collecting location to which the bobbin can be rolled on said rolling surface under the influence of gravity water said decoupling or separating device has decoupled or separated the bobbin in the end position.

31. In a machine having a rotatable configuration of a bobbin cylinder element and a bobbin element resting on the bobbin cylinder element for winding elongated material onto the bobbin element at a traversing motion, one of the elements being fixed and one of the elements being driven, and a carrier being movable relative to the one element for supporting the other of the elements, an apparatus for controlling at least one of contact pressure and relative motion of the elements, comprising a torque adjuster connected to the carrier, and a control device connected to said adjuster for controlling the contact pressure with said adjuster to provide slip between the partners in ribbon zones resulting from the traversing motion.

* * * * *